US006012422A

United States Patent [19]

Coleman

[11] Patent Number: 6,012,422

[45] Date of Patent: Jan. 11, 2000

[54] ENGINE PRIMER DISPENSER

[75] Inventor: Larry E. Coleman, Memphis, Tenn.

[73] Assignee: Life Automotive Products, Inc., Memphis, Tenn.

[21] Appl. No.: 09/102,411

[22] Filed: Jun. 22, 1998

[51] Int. Cl.[7] ..... F01M 1/12

[52] U.S. Cl. ..... 123/196 S; 123/196 R; 184/6.4

[58] Field of Search ..... 123/196 R, 196 S; 184/6.3, 6.4

[56] References Cited

U.S. PATENT DOCUMENTS

| | | | |
|---|---|---|---|
| 2,510,701 | 6/1950 | Cross | 134/95 |
| 3,180,759 | 4/1965 | Falk | 134/22 |
| 3,431,145 | 3/1969 | Riley | 134/22 |
| 3,842,937 | 10/1974 | Lippay et al. | 184/6.3 |
| 4,059,858 | 11/1977 | Lambel et al. | 4/255 |
| 4,412,551 | 11/1983 | Peters et al. | 134/104 |
| 4,513,704 | 4/1985 | Evans | 123/196 S |
| 4,524,734 | 6/1985 | Miller | 123/196 S |
| 4,551,181 | 11/1985 | Stearman | 134/22.11 |
| 4,553,587 | 11/1985 | Traylor | 165/95 |
| 4,911,211 | 3/1990 | Andersen | 141/7 |
| 4,920,996 | 5/1990 | Flanner | 134/22.11 |
| 5,015,301 | 5/1991 | Baylor et al. | 134/22.1 |
| 5,021,096 | 6/1991 | Abadi | 134/22.14 |
| 5,035,516 | 7/1991 | Pacheco | 383/41 |
| 5,094,757 | 3/1992 | Light | 210/712 |
| 5,103,878 | 4/1992 | Cassia | 141/65 |
| 5,197,424 | 3/1993 | Blum | 123/196 S |
| 5,385,613 | 1/1995 | Coleman | 134/22.1 |
| 5,392,796 | 2/1995 | Coleman | 134/102.2 |
| 5,460,097 | 10/1995 | Nekola | 123/196 S |
| 5,488,935 | 2/1996 | Berry, Jr. | 123/196 S |
| 5,655,495 | 8/1997 | Richards | 123/196 S |
| 5,694,896 | 12/1997 | Melvin | 123/196 S |

OTHER PUBLICATIONS

APD Transmission Parts, "The Pulsator", *Transmission Digest* (Jul., 1993).

Raccoon Industries, "What Took So Long", *Transmission Digest* (May, 1993).

Glassinger & Co., "Cooler/Converter Flusher" (Aug., 1993).

*Primary Examiner*—Noah P. Kamen

*Assistant Examiner*—Hai Huynh

*Attorney, Agent, or Firm*—Walker, McKenzie & Walker, P.C.

[57] ABSTRACT

A single-use aerosol can having an outlet and no inlet and containing a lubricant under pressure that is used to prime an engine prior to start-up. The contents of the canister are pressurized with a substantially non-flammable propellant and are released from the single outlet atop the aerosol can through a valve that is interposed between the outlet and the interior of the canister. The valve may be manually depressed to cause the lubricant to be released. The lubricant is transported directly from the outlet of the canister to the interior of the engine through a hose having a first passageway, a first end, and a second end. The hose is sealingly connected to the canister on the first end and the oil passageway of the engine on the second end. A threaded fitting having a second passageway may be used to attach the second end of the hose to the oil passageway, thereby creating communication between the first and second passageways. An adapter of a different outer diameter than that of the threaded fitting may be used to seal the threaded fitting to a non-standard oil passageway so that the adapter may threadedly receive the threaded fitting.

4 Claims, 1 Drawing Sheet

ENGINE PRIMER DISPENSER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION

1. Field of the Invention

The present invention relates, in general, to engines and the lubrication thereof, and in particular, to dispensers of lubricant for such engines.

2. Description of the Related Art

Standard internal combustion engines are equipped with an oil pump that forces a lubricant onto the moving parts of the engine during operation. This oil pump, however, only operates when the engine is running. When an engine is first assembled or rebuilt, or if it remains unused for a long period of time, adequate lubricant is not present on the engine parts from the time the engine is started until the oil pump has had enough time to build up sufficient pressure. This causes significant friction and wear on the bearings and other parts of the engine. It is estimated that somewhere between 70 and 90 percent of all engine damage is caused during these so-called "cold starts". The damage caused by "cold starts" is well recognized in the industry, and a reduction of such damage greatly extends the life of the engine. As a result, many devices have been conceived that offer a solution to the problem by priming the engine with a lubricant before it is started for the first time.

Examples of the prior art include devices that are connected to the ignition switch of a vehicle and that are activated by the use of solenoids that cause the release of lubricant when the ignition switch is placed in an on position. Another example involves a device that permanently attaches to the vehicle, and many of the devices in the prior art are intended for repeated use throughout the life of the engine to which the device is permanently attached, or for repeated use o a sequence of engines being repaired. While some of the prior art successfully achieve the goal of lubricating an engine before it is started, they do so in a manner that is expensive, time consuming, or relatively difficult to set up, requiring elaborate preparations for use.

BRIEF SUMMARY OF THE INVENTION

The present invention is a single-use aerosol dispenser that contains a lubricant under pressure that may be manually dispensed in order to prime an engine before start-up after the initial assembly of the engine or after the engine has been rebuilt, thus reducing friction and wear on the engine parts. The aerosol dispenser has only one outlet from its canister so that, once its contents are dispensed, the empty can is simply discarded and is not re-used or refilled. The canister is pressurized at a level substantially above atmospheric pressure using a propellant that is preferably substantially non-flammable. The lubricant is released from the interior of the canister through the outlet by the use of a valve interposed between the interior of the canister and the outlet. The lubricant is directly transported from the canister to an oil passageway of the engine through coupling means, preferably including a flexible hose, that is sealingly connected to the canister on one end and to the oil passageway on the other. The coupling means may include threaded fitting means and threaded adapter means that will cause the lubricant to flow directly from the outlet of the canister to the interior of the engine upon manual depression of a valve on the aerosol canister.

It is an object of the present invention to provide an inexpensive, singleuse, self-contained apparatus for priming an engine with a lubricant prior to start-up.

DETAILED DESCRIPTION OF THE INVENTION

Figure 1:
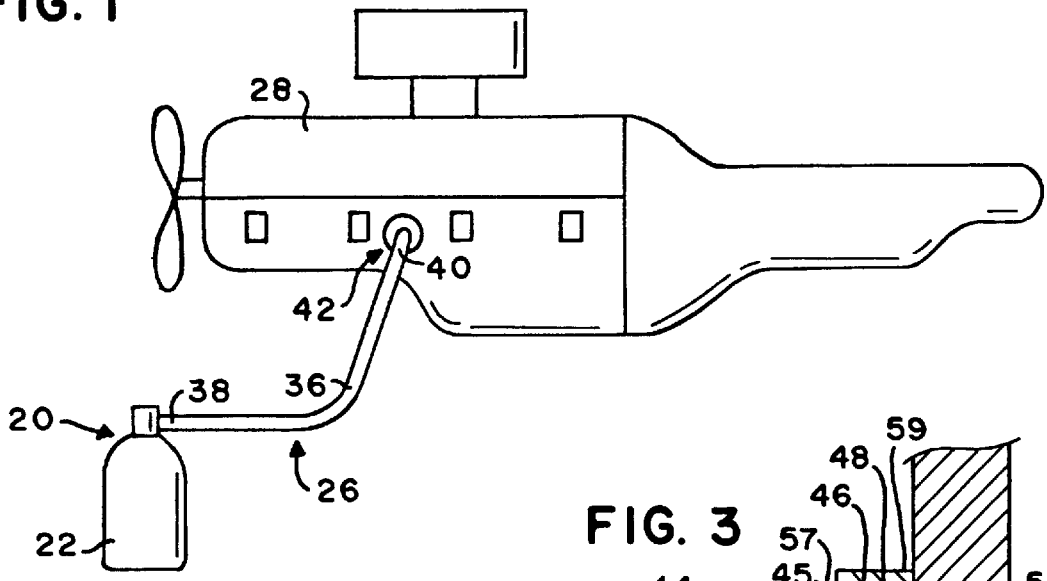
FIG. 1 is a view of the present invention sealingly connected to an oil passageway of an engine.
Figure 3:
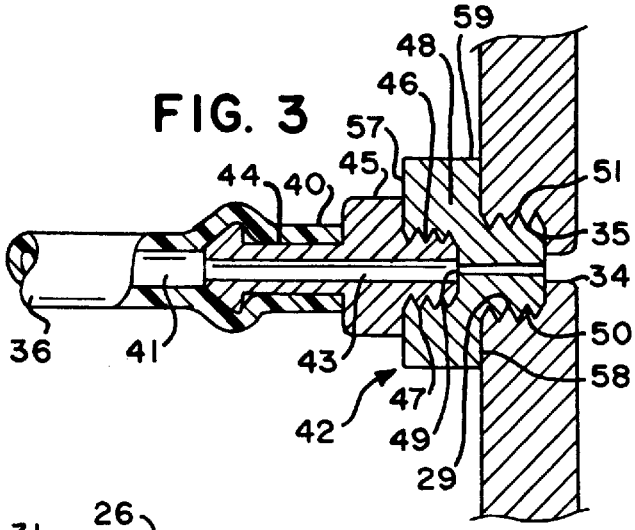
FIG. 3 is a cross-sectional view of the threaded fitting means and threaded adapter means of the present invention interconnected to the hose and to an oil passageway of an engine.
Figure 2:
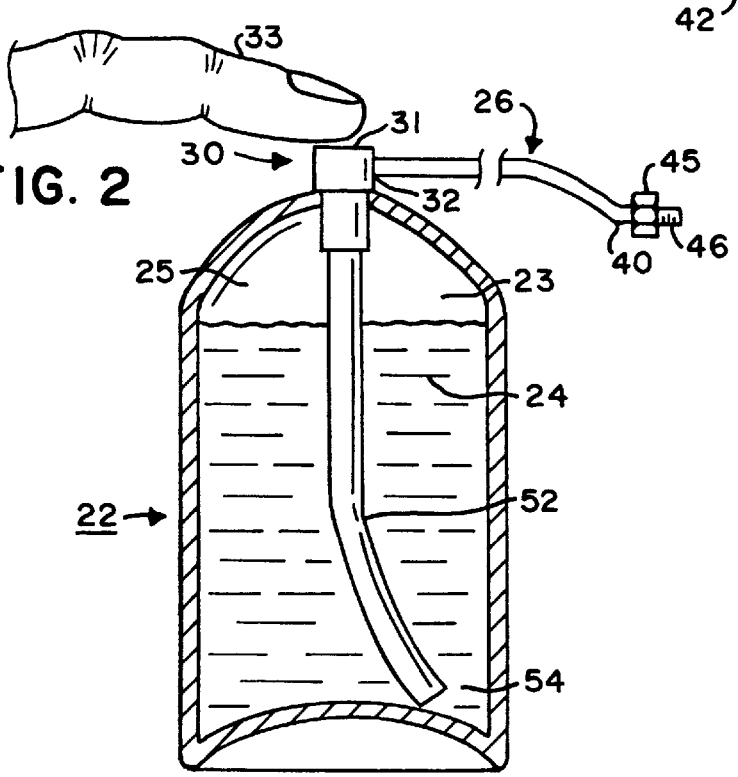
FIG. 2 is a sectional view of the canister of the present invention showing the lubricant therein and manual operation of the valve.

Referring to FIGS. 1–3, the single-use aerosol dispenser 20 of the present invention is seen to comprise a sealed pressurized canister 22 holding a lubricant 24 therein, coupling means 26 for transporting the lubricant 24 to the interior of an engine 28, and valve means 30 for selectively placing the coupling means 26 in communication with the interior 23 of the canister 22 and selectively passing the lubricant 24 from within the canister 22 to the coupling means 26.

Canister 22 has a single outlet 32 and no inlet and is internally pressurized to a level substantially above atmospheric pressure. The lubricant 24 inside of the canister 22 is under pressure from a propellant 25 that is preferably substantially non-flammable such as carbon dioxide or 1,1-difluoroethane and that is preferably environmentally safe, with no ozone-destroying gases, i.e., having no Volatile Organic Compounds (VOCs). The 1,1-difluoroethane is preferably the aerosol propellant sold under the trademark DYMEL 152*a* and manufactured by DuPont Fluorochemicals, Wilmington, Del. 19898. For adequate lubrication, preferably about one-half to three-fourths of a quart of lubricant 24, preferably well-known motor oil, should be contained within the canister 22 with a pressurized propellant 25 filling the remaining volume of the interior 23 of the canister 22. The size of the canister 22 may vary according to the propellant 25 used to force the lubricant 24 out of the canister 22. For example, to provide the same amount of pressure for the same volume of lubricant 24, carbon dioxide would require use of a larger canister 22 than 1,1-difluoroethane, and the use of pressurized air as the propellant 25 would require a still larger canister 22 than either of the previously-mentioned propellants 25 for the same volume of oil. Some propellants 25, such as 1,1-difluoroethane, provide adequate pressure but may appear unsightly to the user, causing the lubricant 24 to be cloudy but still functional.

Coupling means 26 is adapted for sealingly connecting the outlet 32 of the canister 22 to an oil passageway 34 of an engine 28. Coupling means 26 preferably comprises a flexible hose 36, preferably three feet (one meter) in length, having a first end 38, a second end 40, and an axial first passageway 41 therethrough, and further comprises threaded fitting means 42 for threadedly sealing second end 40 of hose 36 to an oil passageway 34 of the engine 28. Passageway 41 preferably has an inner diameter of 3/16 inch (4.76 mm).

Threaded fitting means 42 has a second passageway 43 therethough and preferably further comprises a nipple 44, having an integral, one-piece nut 45 joined thereto, and a threaded male component 46 joined to nut 45 remote from nipple 44 and having external threads 47 for being received into the oil passageway 34. The outer diameter of the nipple 44 of threaded fitting means 42 should be slightly larger than the inner diameter of the first passageway 41 of hose 36 so that the nipple 44 may be forcibly and frictionally inserted into the first passageway 41 of the hose 36, thereby causing threaded fitting means 42 to be frictionally attached to the second end 40 of the hose 36 and creating sealed communication between the first passageway 41 of the hose 36 and the second passageway 43 of threaded fitting means 42. The first end 38 of the hose 36 is also in communication with valve means 30 through the first passageway 41 of the hose 36. When threaded fitting means 42 threadedly seals the second end 40 of the hose 36 to the oil passageway 34, the second passageway 43 is thereby placed in sealed communication with the oil passageway 34 of the engine 28. Nut 45 of threaded fitting means 42 may be tightened with a standard well-known wrench to make the present invention seal with oil passageway 34 of the engine 28.

The oil passageway 34 may be any threaded hole 29 on the exterior of the engine 28 that leads to the interior of the engine 28, and the inner diameter and threading 35 of oil passageway 34 may vary according to the type and manufacturer of engine 28. For example, the oil passageway 34 of the engine 28 may be the well-known threaded hole 29 into engine 28 for receipt of a wellknown oil pressure sensor. For many engines, the standard diameter and threading 47 of male component 46 of threaded fitting means 42 will fit directly into the oil passageway 34. On other engines, having non-standard diameters or threading of oil passageway 34, as, for example, the inner diameter and threading 35 of oil passageway 34 shown in FIG. 3, a plurality of adapters, such as threaded adapter means 48, are provided with the present invention for threadedly sealing threaded fitting means 42 to oil passageway 34.

Threaded adapter means 48 has a standard threaded female receptacle 49 on a first side 57 for threaded mating receipt of threaded male component 46 of threaded fitting means 42, and, on a second side 58 remote from first side 57, has one of a selected set of threaded adapter male portions 50 having an outer diameter and threads 51 adapted for mating into the non-standard oil passageway 34 as shown in FIG. 3.

Valve means 30 is interposed between the coupling means 26 and the canister 22 for selectively placing the coupling means 26 in communication with the interior 23 of the canister 22. Valve means 30 is preferably operated by mechanical manual depression of the top surface 31 of the valve means 30, for example, by the finger 33 of the user, thereby causing the lubricant 24 to be selectively passed from the interior 23 of the canister 22 to the coupling means 26. When released, the lubricant flows directly through coupling means 26 and into the interior of an engine 28. Valve means 30 is well-known to those skilled in the art, and an acceptable valve means for use with the present invention is the part number E11608 valve manufactured by Precision Valve, 700 Nepperhan Ave., Yonkers, N.Y. 10703, and sold by Speer Products Incorporated, 4242 B.F. Goodrich Blvd., Memphis, Tenn. 38118.

The interior 23 of the canister 22 preferably has a tube 52 extending from the outlet 32 to a region 54 of the interior cavity 23 that is remote from the outlet 32. The interior cavity 23 also may have a well-known bladder therewithin, not shown, within which the lubricant 24 is held, with propellant 25 being within interior 23 of canister 22 and external to the bladder and thereby causing the lubricant to be dispensed as the bladder collapses under pressure of the propellant. It will be noted that, when a bladder is used as described herein above, there will be no mixing of the propellant with the lubricant, thereby preventing cloudiness of the lubricant and preventing escape of the propellant from the canister.

To use the present invention, the well-known oil pressure sensor of engine 28 may be disconnected by unscrewing it from the engine in a manner leaving an exposed threaded hole 29 that communicates with oil passageway 34. Threaded fitting means 42 is then screwed into the threaded hole 29 of the oil passageway 34 left open by the removal of the oil pressure sensor. If necessary, threaded adapter means 48, having threaded male portion 50 of the required outer diameter and threading 51, may be screwed onto the threaded male component 46 of threaded fitting means 42 by screwingly receiving male component 46 into female receptacle 49, and the threaded adapter male portion 50 of threaded adapter means 48 may then be screwingly received into the threaded hole 29 of the oil passageway 34 as by tightening nut 59 of threaded adapter means 48. The nut 45 on threaded fitting means 42 and the nut 59 on threaded adapter means 48 may be tightened with a wrench to make certain the hose 36 is sealingly secured to the oil passageway 34. The valve means 30 is then manually depressed by the user, thereby causing the lubricant 24 to be forced from the interior 23 of the canister 22 by propellant 25 and into the first passageway 41 of the hose 36. The lubricant 24 flows from the first passageway 41 though the second passageway 43 and directly into the interior of the engine 28 through oil passageway 34, thereby lubricating the wearing parts of engine 28. When the canister 22 is empty and substantially all of the lubricant 24 has been transported into the engine 28, threaded fitting means 42 may be unscrewed from the oil passageway 34 and the dispenser 20 discarded. The oil pressure sensor can then be replaced, thereby sealing oil passageway 34, and the engine 28 can be safely started.

Although the present invention has been described and illustrated with respect to a preferred embodiment and a preferred use therefor, it is not to be so limited since modifications and changes can be made therein which are within the full intended scope of the invention.

I claim:

1. A single-use aerosol dispenser holding motor oil under pressure, said dispenser including:

(a) a sealed pressurized canister having an outlet and no inlet, said canister having said motor oil contained in an interior cavity formed within said canister and said canister being internally pressurized substantially above atmospheric pressure by a substantially non-flammable propellant;

(b) coupling means for transporting said motor oil to the interior of an engine, said coupling means adapted for sealingly connecting said outlet to an oil passageway of the engine;

(c) valve means, interposed between said coupling means and said canister, for selectively placing said coupling means in communication with the interior of said canister, said valve means being mechanically finger-operated in response to manual depression thereof for selectively passing said motor oil from within said canister to said coupling means;

(d) a tube located in said interior cavity of said canister extending from said outlet to a region within the interior of said canister remote from said outlet so as to place said region in communication with said outlet through said tube;

(e) a hose having a first end and a second end and a first passageway therethrough, said first end of said hose being in communication with said valve means through said passageway;

(f) threaded fitting means attached to said second end of said hose and adapted for threadingly sealing said second end of said hose to the oil passageway of the engine, said threaded fitting means having a second passageway therethrough in communication with said first passageway of said hose and, when said threaded fitting means threadedly seals said second end of said hose to the oil passageway of the engine, said second passageway being in communication with the oil passageway of the engine; and (g) threaded adapter means, threadedly receiving said threaded fitting means, for threadedly sealing said threaded fitting means to the oil passageway of the engine, said threaded adapter means having a different threaded outer diameter than said threaded fitting means, said threaded adapter means including a plurality of adapters, each adapter of said plurality of adapters having a different threaded outer diameter from each other adapter of said plurality of adapters.

2. The dispenser as recited in claim 1, in which said propellant is carbon dioxide.

3. The dispenser as recited in claim 1, in which said propellant is 1,1-difluoroethane.

4. A single-use aerosol dispenser holding a motor oil under pressure, said dispenser including:

(a) a sealed pressurized canister having an outlet and no inlet, said canister having said motor oil contained in an interior cavity formed within said canister and said canister being internally pressurized substantially above atmospheric pressure by a substantially non-flammable propellant;

(b) coupling means for transporting said motor oil to the interior of an engine, said coupling means adapted for sealingly connecting said outlet to an oil passageway of the engine;

(c) valve means, interposed between said coupling means and said canister, for selectively placing said coupling means in communication with the interior of said canister, said valve means being mechanically finger-operated in response to manual depression thereof for selectively passing said motor oil from within said canister to said coupling means;

(d) a tube located in said interior cavity of said canister extending from said outlet to a region within the interior of said canister remote from said outlet so as to place said region in communication with said outlet through said tube;

(e) a hose having a first end and a second end and a first passageway therethrough, said first end of said hose being in communication with said valve means through said passageway;

(f) threaded fitting means attached to said second end of said hose and adapted for threadingly sealing said second end of said hose to the oil passageway of the engine, said threaded fitting means having a second passageway therethrough in communication with said first passageway of said hose and, when said threaded fitting means threadedly seals said second end of said hose to the oil passageway of the engine, said second passageway being in communication with the oil passageway of the engine.

* * * * *